US008353398B2

(12) United States Patent
DePaula et al.

(10) Patent No.: US 8,353,398 B2
(45) Date of Patent: Jan. 15, 2013

(54) PACKAGE FOR BEVERAGE-TYPE CONTAINERS

(75) Inventors: Andrea Coltri DePaula, Sao Jose dos Campos (BR); Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 24 days.

(21) Appl. No.: 12/971,297

(22) Filed: Dec. 17, 2010

(65) Prior Publication Data

US 2011/0226845 A1 Sep. 22, 2011

Related U.S. Application Data

(60) Provisional application No. 61/284,539, filed on Dec. 18, 2009, provisional application No. 61/400,581, filed on Jul. 30, 2010.

(51) Int. Cl.
*B65D 75/00* (2006.01)
*B65D 71/42* (2006.01)

(52) U.S. Cl. ..... 206/148; 206/158; 206/427; 229/87.2

(58) Field of Classification Search ..... 206/141, 206/145–149, 161–162; 294/87.2
See application file for complete search history.

(56) References Cited

U.S. PATENT DOCUMENTS

| | | | |
|---|---|---|---|
| 1,527,399 | A | 2/1925 | Davidson |
| 2,111,621 | A | 3/1938 | Gerking |
| 2,289,859 | A | 7/1942 | Arthur |
| 2,522,950 | A | 9/1950 | Keith |
| 2,575,654 | A | 11/1951 | Casler |
| 2,798,603 | A | 7/1957 | Grinspoon |
| 2,950,041 | A | 8/1960 | Stone |
| 3,073,440 | A | 1/1963 | Jones |
| 3,528,697 | A | 9/1970 | Wood |
| 3,897,873 | A | 8/1975 | Graser |
| 3,942,631 | A | 3/1976 | Sutherland et al. |
| 4,029,204 | A | 6/1977 | Manizza |

(Continued)

FOREIGN PATENT DOCUMENTS

EP 0 240 126 A2 10/1987

(Continued)

OTHER PUBLICATIONS

Office Action for Canadian Application No. 2,705,561, dated Sep. 15, 2011.

(Continued)

*Primary Examiner* — Bryon Gehman
(74) *Attorney, Agent, or Firm* — Womble Carlyle; Sandridge & Rice, LLP

(57) ABSTRACT

A package for holding a plurality of articles. The package has panels that cooperate to at least partially form an interior of the package. The panels comprise a top panel, at least one side panel foldably connected to the top panel, and at least one end panel foldably connected to the top panel. At least one opening is in the top panel for at least partially receiving at least a portion of one of the articles. At least one retention flap is foldably connected to the top panel adjacent the at least one opening. The at least one retention flap has a free edge for engaging at least one article of the plurality of articles. The at least one retention flap is at least partially defined by at least one J-shaped cut.

22 Claims, 16 Drawing Sheets

U.S. PATENT DOCUMENTS 4,096,985 A 6/1978 Wood
4,190,149 A 2/1980 Oliff et al.
4,304,329 A 12/1981 Graser
4,372,599 A 2/1983 Kiedaisch et al.
4,378,878 A * 4/1983 Graser ..... 206/153
4,378,879 A 4/1983 Killy
4,382,505 A 5/1983 Sutherland et al.
4,386,699 A 6/1983 Sutherland
4,403,689 A 9/1983 Wood
4,465,180 A 8/1984 Klygis
4,646,917 A 3/1987 Schuster
4,681,217 A 7/1987 Hernandez
4,736,977 A 4/1988 Killy
4,784,266 A 11/1988 Chaussadas
4,941,624 A 7/1990 Schuster
5,139,147 A 8/1992 Sutherland
5,163,548 A 11/1992 Domansky
5,188,225 A 2/1993 Jorba et al.
5,201,412 A 4/1993 Schuster et al.
5,267,644 A 12/1993 Tsao et al.
5,273,156 A 12/1993 Harris
5,297,673 A 3/1994 Sutherland
5,310,050 A 5/1994 Sutherland
5,310,051 A 5/1994 Sutherland
5,311,994 A 5/1994 Oliff
5,314,224 A 5/1994 Bates
5,323,895 A 6/1994 Sutherland et al.
5,328,024 A 7/1994 Sutherland
5,344,006 A 9/1994 Mazzeo
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,443,153 A 8/1995 Sutherland
5,445,262 A 8/1995 Sutherland
5,452,799 A 9/1995 Sutherland
5,474,172 A 12/1995 Zavatone et al.
5,501,335 A 3/1996 Harris
5,503,267 A 4/1996 Sutherland
5,520,283 A 5/1996 Sutherland
5,524,756 A 6/1996 Sutherland
5,551,566 A 9/1996 Sutherland
5,582,289 A 12/1996 Wright
5,590,776 A 1/1997 Galbierz et al.
5,593,027 A 1/1997 Sutherland
5,639,017 A 6/1997 Fogle
5,735,394 A 4/1998 Harrelson
5,746,310 A 5/1998 Slomski
5,791,463 A 8/1998 Negelen
5,794,778 A 8/1998 Harris
5,816,391 A 10/1998 Harris
5,871,090 A 2/1999 Doucette et al.
5,873,515 A 2/1999 Dunn et al.
5,915,546 A 6/1999 Harrelson
5,921,392 A 7/1999 Davis
5,960,945 A 10/1999 Sutherland
5,979,747 A 11/1999 Gnadt et al.
5,992,733 A 11/1999 Gomes
6,059,099 A 5/2000 Galbierz
6,065,590 A 5/2000 Spivey
6,315,111 B1 11/2001 Sutherland
6,484,903 B2 11/2002 Spivey et al.
6,896,130 B2 5/2005 Theelen
6,926,193 B2 8/2005 Smalley
7,011,209 B2 3/2006 Sutherland et al.
7,823,721 B2 * 11/2010 Sutherland et al. ..... 206/153
2002/0195371 A1 12/2002 Brown
2003/0080004 A1 5/2003 Olsen et al.
2003/0111362 A1 6/2003 Sutherland et al.
2003/0213705 A1 11/2003 Woog
2005/0127151 A1 6/2005 Johnson
2007/0029371 A1 2/2007 Theelen
2007/0164091 A1 7/2007 Fogle et al.
2007/0181658 A1 8/2007 Sutherland
2009/0101526 A1 4/2009 Sutherland
2009/0127147 A1 5/2009 Sutherland
2009/0250357 A1 10/2009 Spivey, Sr.
2010/0078337 A1 4/2010 Sutherland et al.
2010/0264043 A1 10/2010 De Paula
2011/0000799 A1 1/2011 Gonzalez et al.

FOREIGN PATENT DOCUMENTS

EP 0 240 126 A3 10/1987
EP 0 425 135 A2 5/1991
EP 0 428 354 A1 5/1991
GB 2 238 285 A 5/1991
GB 2321229 A 7/1998
JP 03-148459 6/1991
JP 03-176374 7/1991
JP 08-509944 10/1996
JP 2003146359 A 5/2003
JP 2003300554 A 10/2003
WO 9422738 A1 10/1994
WO 9501289 A1 1/1995
WO 9523745 9/1995
WO WO 95/23745 9/1995

OTHER PUBLICATIONS

Office Action for Canadian Application No. 2,699,990, dated Aug. 16, 2011.
Office Action for Canadian Application No. 2,705,561 dated Mar. 1, 2012.
Supplementary European Search Report for EP 09 82 2676 dated Mar. 5, 2012.
International Search Report and Written Opinion dated Aug. 18, 2011 for PCT/2010/060973.
Notification of Reason for Refusal dated Jun. 4, 2012 for JP Application No. 2010-534199 and English translation.

* cited by examiner

PACKAGE FOR BEVERAGE-TYPE CONTAINERS

CROSS-REFERENCE TO RELATED APPLICATIONS

This Application claims the benefit of U.S. Provisional Patent Application No. 61/284,539, filed Dec. 18, 2009, and U.S. Provisional Patent Application No. 61/400,581, filed Jul. 30, 2010.

INCORPORATION BY REFERENCE

U.S. Provisional Patent Application No. 61/284,539, filed Dec. 18, 2009, and U.S. Provisional Patent Application No. 61/400,581, filed Jul. 30, 2010, are hereby incorporated by reference for all purposes as if presented herein in their entirety.

BACKGROUND OF THE DISCLOSURE

The present disclosure generally relates to packages or cartons for holding and carrying containers.

SUMMARY OF THE DISCLOSURE

In general, one aspect of the disclosure is generally directed to a package for holding a plurality of articles. The package comprises panels that cooperate to at least partially form an interior of the package. The panels comprise a top panel, at least one side panel foldably connected to the top panel, and at least one end panel foldably connected to the top panel. At least one opening in the top panel for at least partially receiving at least a portion of one of the articles. At least one retention flap is foldably connected to the top panel adjacent the at least one opening. The retention flap has a free edge for engaging at least one article of the plurality of articles. The retention flap is at least partially defined by at least one J-shaped cut.

In another aspect, the disclosure is generally directed to a blank for forming a package for holding a plurality of articles. The blank comprises panels that comprise a top panel, at least one side panel foldably connected to the top panel, and at least one end panel foldably connected to the top panel. At least one opening is in the top panel for at least partially receiving at least a portion of one of the articles when the blank is formed into the carton. At least one retention flap is foldably connected to the top panel for being adjacent the at least one opening when the blank is formed into the carton. The retention flap has a free edge for engaging at least one article of the plurality of articles. The retention flap is at least partially defined by at least one J-shaped cut.

In another aspect, the disclosure is generally directed to a method of forming a package. The method comprises obtaining a blank comprising panels that comprise a top panel, at least one side panel foldably connected to the top panel, and at least one end panel foldably connected to the top panel. At least one retention flap is foldably connected to the top panel and at least partially defined by at least one J-shaped cut. The method comprises positioning a plurality of articles relative to the blank and positioning the blank relative to the articles so that the plurality of articles are at least partially received in a respective receptacle having an opening that is adjacent the at least one retention flap. The method comprises further positioning the blank relative to the articles so that a respective free edge of the at least one retention flap engages a respective article to hold the articles in engagement with the package.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to constructs, sleeves, cartons, or the like, and packages for holding and displaying containers such as bottles, jars, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Packages according to the present disclosure can accommodate containers of numerous different shapes. For the purpose of illustration and not for the purpose of limiting the scope of the disclosure, the following detailed description describes beverage containers (e.g., plastic containers) at least partially disposed within the package embodiments. In this specification, the terms "lower," "bottom," "upper" and "top" indicate orientations determined in relation to fully erected packages.

Figure 7:
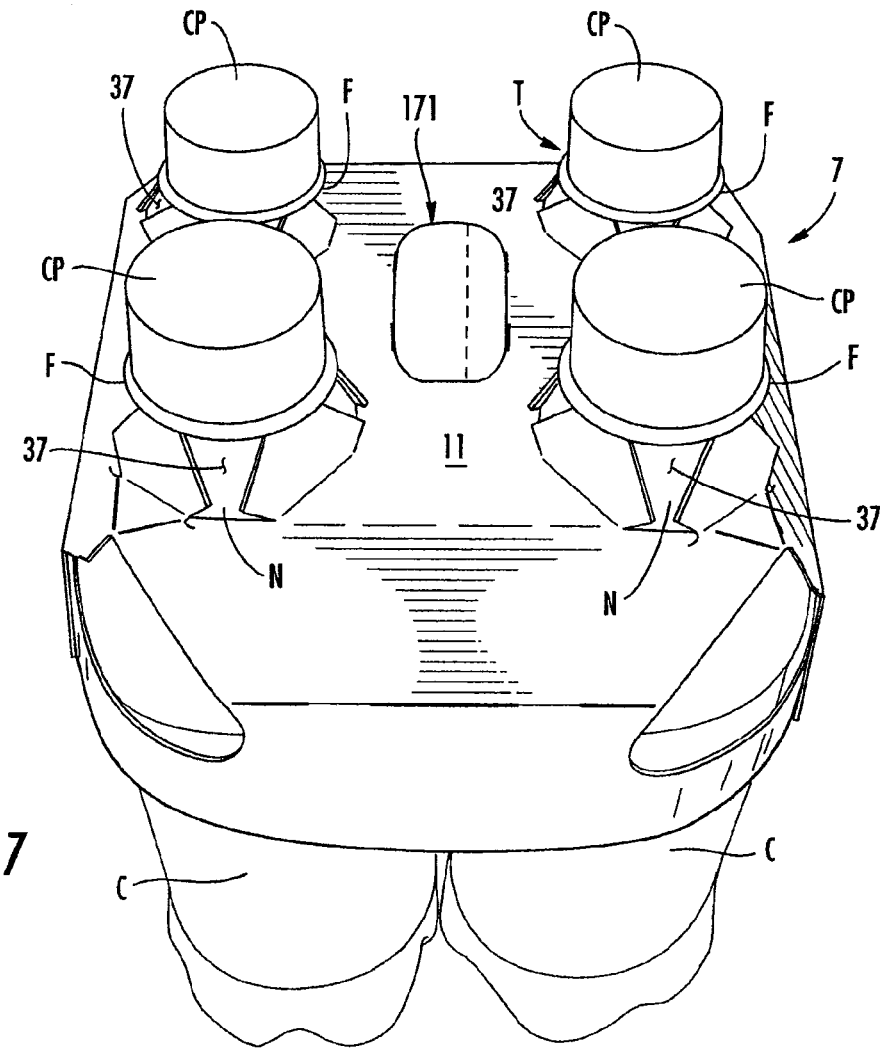
FIG. 7 is a perspective of the package of the first embodiment.

The present embodiments are addressed to cartons or packages for attachment to and accommodation of containers C (FIG. 7). A package or carrier of the present disclosure has similar features as the package disclosed in U.S. patent application Ser. No. 12/603,727, that is incorporated by reference herein for all purposes. In one embodiment, the containers C are beverage containers as disclosed in the '727 application, having a top portion T generally comprising a flange portion F, an upper neck portion N, and a cap CP, but containers of other sizes, shapes, and configurations, may be held in the package without departing from the disclosure. The containers C are received are retained in the package by retaining features described further herein. The containers C could be arranged in other than the 2×2 arrangement illustrated in FIG. 7 (e.g., 2×3, 2×4, 1×3, 1×4, 3×3, 3×4, etc.) without departing from the disclosure.

Figure 1:
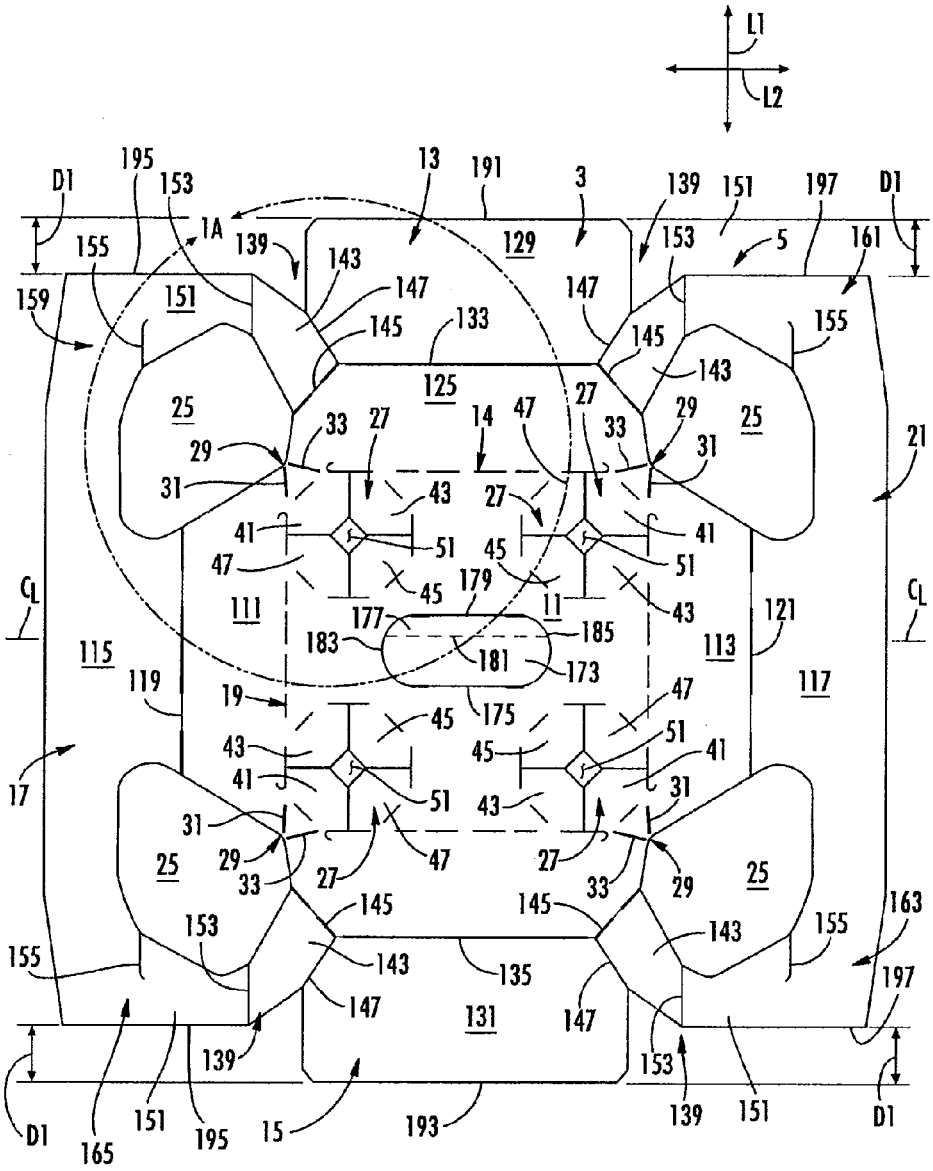
FIG. 1 is a plan view of an exterior surface of a blank for forming a package of a first embodiment of the disclosure.

FIG. 1 is a plan view of an exterior side 3 of a blank 5 used to form the package or carrier 7 (FIG. 7). The blank 5 has a longitudinal axis L1 and a lateral axis L2. The blank 3 comprises a top panel 11 foldably connected to a first end panel 13 at a lateral fold line 14, and a second end panel 15 foldably connected to the top panel at a lateral fold line 16. A first side panel 17 is foldably connected to the top panel 10 at a longitudinal fold line 19, and a second side panel 21 is foldably connected to the top panel 10 at a longitudinal fold line 23. In the illustrated embodiment, the fold lines 14, 16, 19, 23 that define the top panel 11 comprises spaced apart cuts or perforations, but the fold lines could comprise other forms or lines of weakening (e.g., score lines that do not penetrate the thickness of the blank 5) without departing from the disclosure. In one embodiment, the blank 5 comprises four openings 25 that at least partially define the side panels 17, 21, end panels 13, 15 and top panel 11. In one embodiment, the top panel 11, end panels 13, 15, and side panels 17, 21 cooperate to at least partially form an interior of the package 7.

In the illustrated embodiment, the top panel 11 comprises four receptacles 27 adjacent a respective corner 29 of the top panel. In the illustrated embodiment, each corner 29 of the top panel 11 is formed by two oblique fold lines 31, 33 that extend from a respective fold line 14, 16, 19, 23 and converge as the fold lines approach a respective opening 25. Each oblique fold line 31, 33 is oblique relative to a respective fold line 14, 16, 19, 23. But, the fold lines 31, 33 could be otherwise shaped, arranged, and/or configured without departing from the disclosure. For example, the fold lines 31, 33 could be parallel or nonconverging without departing from the disclosure.

In one embodiment, the receptacles 27 each comprises features for forming an opening 37 (FIG. 7) in the top panel 11 that receives the neck portion N of a respective container C when the blank 5 is formed into the package 7. The features of each receptacle 27 comprise four retention flaps 41, 43, 45, 47 that frame a respective opening 51 in the top panel 11 of the blank 5. One receptacle 27 is shown in detail in FIG. 1A, with the other three receptacles each being similarly shaped, arranged, and configured. Each receptacle is at least partially defined by four generally T-shaped cuts 55, 57, 59, 61. Two of the T-shaped cuts 55, 61 each comprise a generally straight cut 63, 65 respectively extending from the opening 51 and a J-shaped cut 67, 69 that is generally orthogonal to the generally straight cut 63, 65. Each J-shaped cut 67, 69 comprises a straight portion 73, 75 generally aligned with a respective fold line 14, 19 and a curved portion 77, 79 extending from a respective straight portion into a respective end panel 13 or side panel 17. The curved portion 77 of the J-shaped cut 67 extends into the end panel 13 at a location adjacent the fold line 33 forming the corner 29 of the top panel 11. The curved portion 79 of the J-shaped cut 69 extends into the side panel 17 at a location adjacent the fold line 31 forming the corner 29 of the top panel 11. In the illustrated embodiment, the curved portions 77, 79 of the J-shaped cuts 67, 69 are spaced apart from respective ends of the fold lines 31, 33 but the J-shaped cuts could be otherwise shaped arranged, and configured (e.g., the curved portions 77, 70 could abut or intersect the fold lines 31, 33) without departing from the disclosure. In the illustrated embodiment, the straight cuts 63, 65 are generally orthogonal relative to a respective J-shaped cut 67, 69 but the straight cuts could be otherwise shaped, arranged, and/or configured without departing from the disclosure. In one embodiment, the corner 29 of the top panel 11 is at least partially defined by the oblique fold lines 31, 33 that extend from a location adjacent a respective J-shaped cut 77, 79 to a location adjacent the opening 25 of the blank 5 wherein the oblique fold lines generally converge. The retention flap 41 can be a corner retention flap that is adjacent the corner 29 of the top panel 11.

Figure 1A:
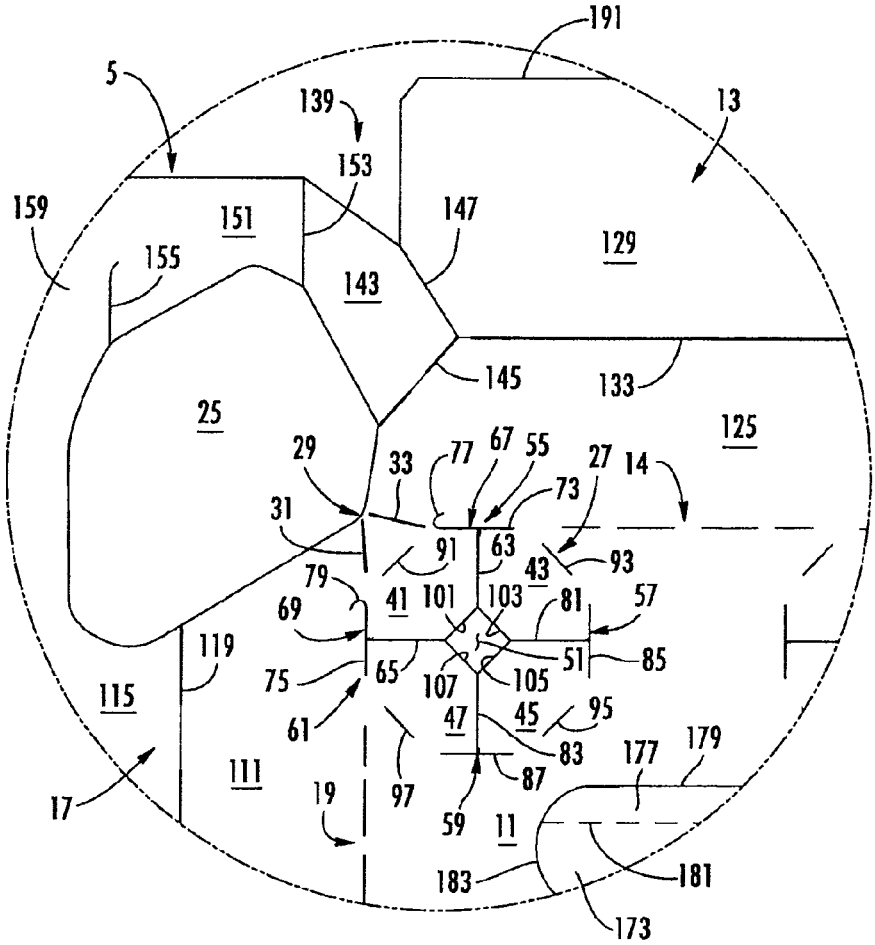
FIG. 1A is an enlarged portion of FIG. 1.

As shown in FIG. 1A, the other two T-shaped cuts 57, 59 comprise a respective first straight portion 81, 83 extending from the opening 51 and a second straight portion 85, 87 that is orthogonal to a respective first straight portion. The T-shaped cuts 57, 79 could be otherwise shaped, arranged, and/or configured without departing from the disclosure.

In one embodiment, each of the retention flaps 41, 43, 45, 47 is at least partially defined by an oblique cut 91, 93, 95, 97 that at least partially defines a respective fold line that foldably connects the retention flap to the top panel 11. The oblique cuts 91, 93, 95, 97 could be other forms or lines of weakening such as crease lines, score lines, or fold lines without departing from the disclosure. When the package 7 is formed, the cuts 91, 93, 95, 97 facilitate folding of the retention flaps 41, 43, 45, 57 along a fold line or line of weakening that extends beyond each respective end of each cut. The fold line formed at the cut 91 defining the retention flap 41 extends generally between the J-shaped cuts 77, 79.

In the embodiment of FIG. 1A, the retention flaps 41, 43, 45, 47 each have a respective free edge 101, 103, 105, 107 that combine to form the opening 51 in the top panel 11. Each of the free edges 101, 103, 105, 107 combine to contact a respective flange F of a container C received in a respective opening 37 in the top panel 11. The free edges 101, 103, 105, 107 of the retention flaps 41, 43, 45 47 engage the container C and restrain the container from removal from the package 7. The free edges 101, 103, 105, 107 of the retention flaps 41, 43, 45, 47 could be otherwise shaped, arranged, and/or configured without departing from the disclosure.

In one embodiment, each of the side panels 17, 21 comprises a first portion 111, 113 adjacent the top panel 11 and a second portion 115, 117 respectively foldably connected to the first portion at a respective longitudinal fold line 119, 121. Each of the longitudinal fold lines extends between respective openings 25 in the blank 5. In one embodiment, each of the end panels comprise a first portion 125, 127 adjacent the top panel 11 and a second portion 129, 131 respectively foldably connected to the first portion at a respective lateral fold line 133, 135.

As shown in FIGS. 1 and 1A, the blank 5 comprises four gussets 139 that connect the side panels 17, 21 to the end panels 13, 15. Each of the gussets 139 comprises a first gusset panel 143 foldably connected to a respective first portion 125, 127 of the end panels 13, 15 at an oblique fold line 145. In the illustrated embodiment, the first gusset panel 143 is free from connection to a respective second portion 129, 131 of the end panels 13, 15 by an oblique cut line 147. The gussets 139 each comprise a second gusset panel 151 foldably connected to the first gusset panel 143 at longitudinal fold line 153. The second gusset panel 151 is at least partially defined by a cut line 155 extending from an edge of a respective opening 25. The second gusset panel 151 is foldably connected to the second portion 115, 117 of a respective side panel 17, 21 by the portion of the blank that is adjacent the end of the cut line 155. As will be described in detail below, the cut line 155 at least partially defines an adhesive portion 159, 161, 163, 165 at each end of a respective side panel 17, 21. The adhesive portions 159, 161, 163 165 comprise the outer marginal portion of the second portions 115, 117 of the side panels 17, 21 that are generally located at respective longitudinal ends of the blank 5.

In the illustrated embodiment, the blank 5 has handle features for forming a handle 171 in the top panel 11 of the package 7 formed from the blank. The handle features comprise a first handle panel 173 foldably connected to the top panel 11 by a lateral fold line 175 and a second handle panel 177 foldably connected to the top panel by a lateral fold line 179. In one embodiment, the handle panels 173, 177 are separable by a tear line 181 extending between respective curved cuts 183, 185. The handle 171 and the features of the blank 5 that form the handle could be otherwise shaped, arranged, configured, and/or omitted without departing from the disclosure.

Figure 2:
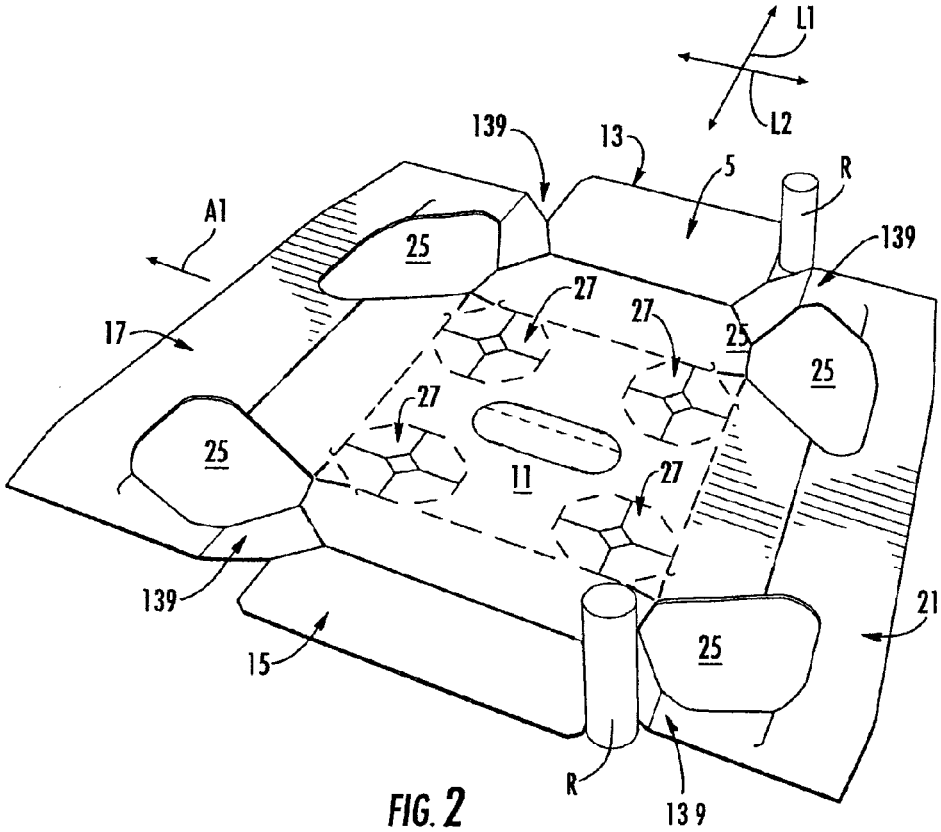
FIG. 2 is a schematic view of the blank of the first embodiment engaged with a portion of a forming machine for forming the blank into a package.

In one embodiment, the blank 5 has outermost edges 191, 193 at the longitudinal ends of the blank 308 corresponding to the free edges of the end panels 13, 15 that are spaced a farther distance from the laterally-extending centerline CL of the blank than the edges 195, 197 of the side panels 17, 21 at the longitudinal ends of the blank. In one embodiment, the outermost edges 191, 193 of the end panels 13, 15 are spaced apart from the edges 195, 197 of the side panels 17, 21 by a distance D1. In one exemplary embodiment, the distance D1 is at least approximately ⅝ inch (approximately 16 mm), but the distance D1 could be more or less without departing from the scope of the disclosure. As shown in FIG. 2 and discussed in detail below, the side panels 17, 21 can be conveyed or positioned in a machine or packaging line for forming the blank 5 into the package 7. The machine can have rods or fingers R that engage the end panels 13, 15 to move the blanks in the downstream direction corresponding to arrow A1. In one embodiment, the direction of arrow A1 is generally perpendicular to the longitudinal axis L1 of the blank 5. The spacing of the edges 191, 193 from the edges 195, 197 facilitates engagement of the blanks and the rods R to convey the blank. Further, the spacing of the edges 191, 193 from the edges 195, 197 allows the side panels 17, 21 to be overlapped while the blanks are conveyed by the rods R.

Figure 3:
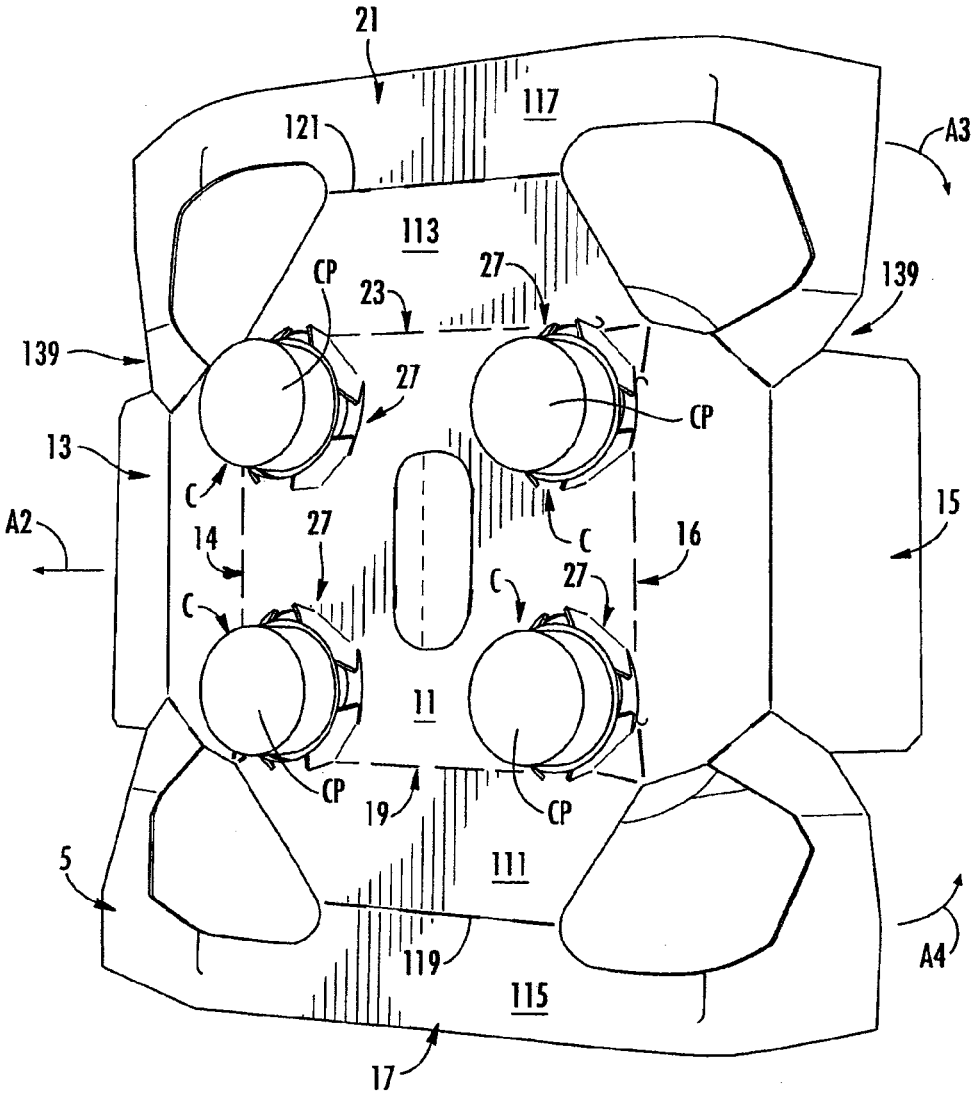
FIGS. 3-6C are various views of the blank of FIG. 1 being formed into the package.

In one exemplary embodiment, the blank 5 can be assembled into a package 7 in the manner generally described herein. The blank 5 can be conveyed in a generally flat state in a machine or packaging line for attaching the blank to containers C and forming the blank and the containers into the package 7. As shown in FIG. 2, the blank 5 or overlapped blanks can be conveyed in the direction of arrow A1 by engagement with rods R of the machine. In one embodiment, the machine can turn the blank 5 from the orientation of FIG. 2 so that the blank is lowered onto the tops of containers C in an orientation wherein the downstream direction of travel is indicated by arrow A2. As the blank 5 is lowered onto the tops of the containers C, the caps CP of the containers are inserted through the receptacles 27 and pushed through the openings 37, and are attached to the blank by engagement with the retention flaps 41, 43, 45, 47. The free edges 101, 103, 105, 107 of a respective retention flap 41, 43, 45, 47 engage the underside of a respective flange F of the containers C to attach the containers to the blank 5. Next, the side panels 17, 21 can be downwardly folded in the direction of arrows A3, A4 (FIG. 3) to the position of FIG. 4 by moving the partially formed package 7 through the machine or packaging line and contacting folders or fingers (not shown) that position the side panels.

Figure 4:
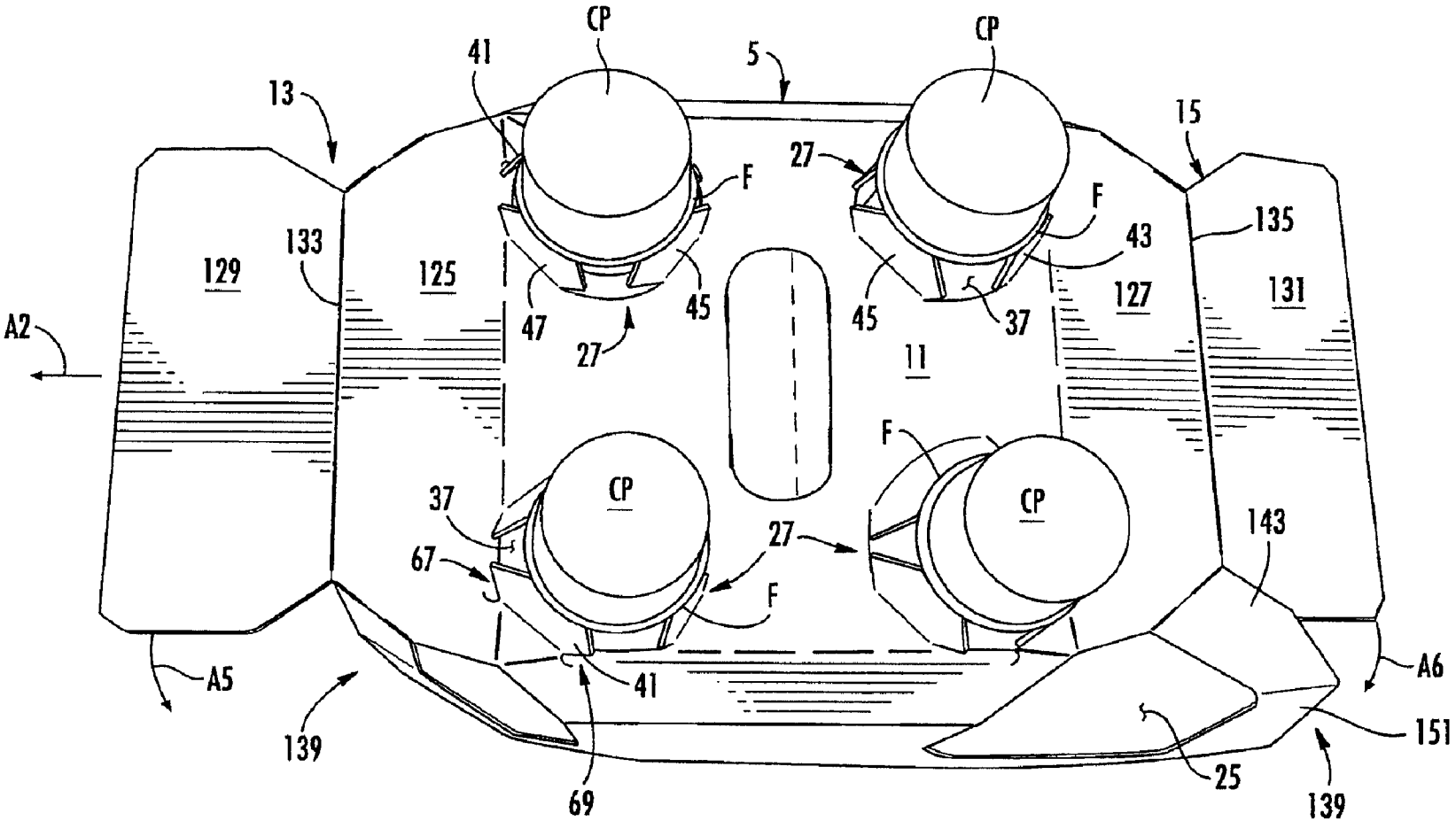
Figure 5:
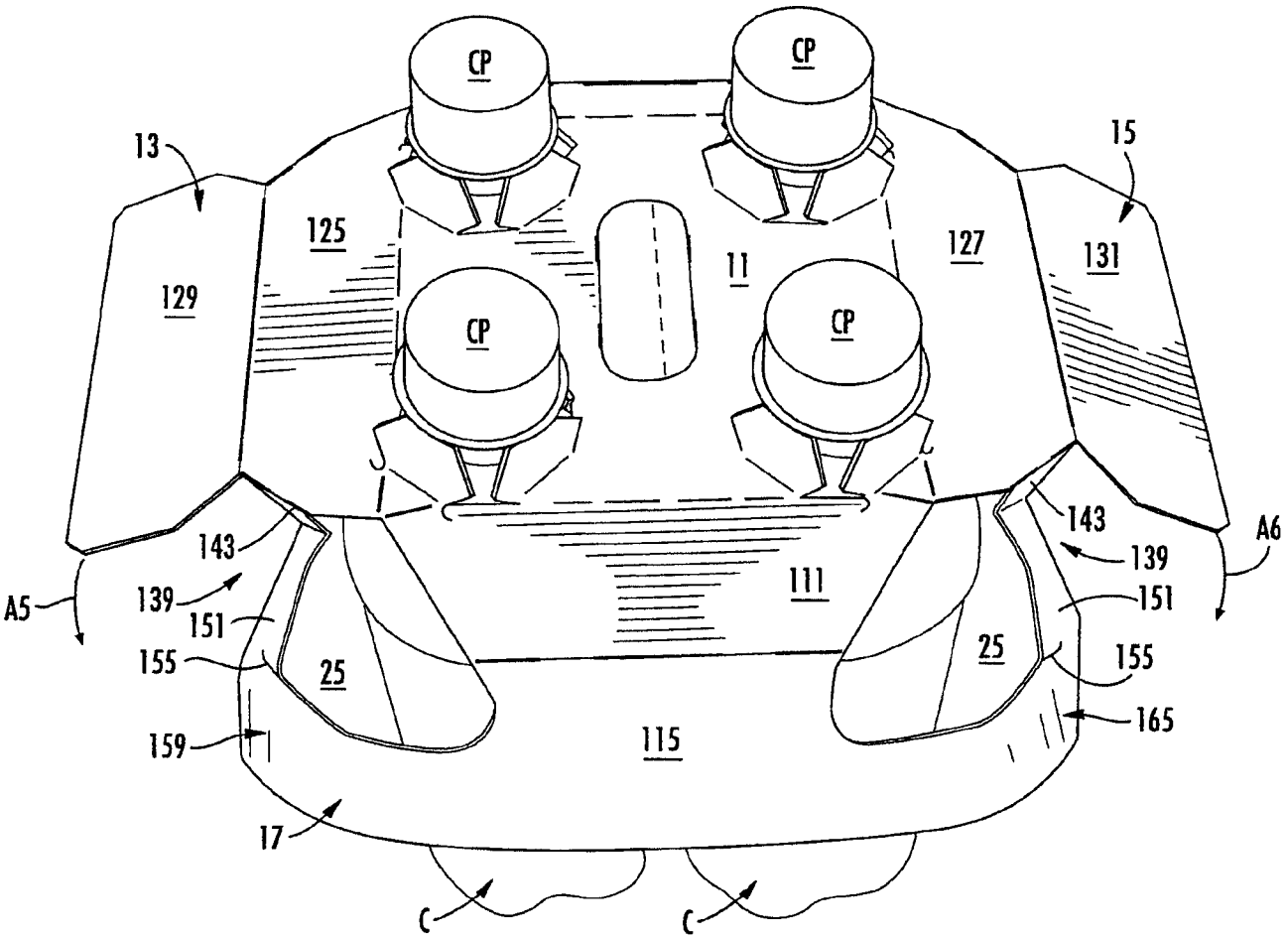
Figure 6:
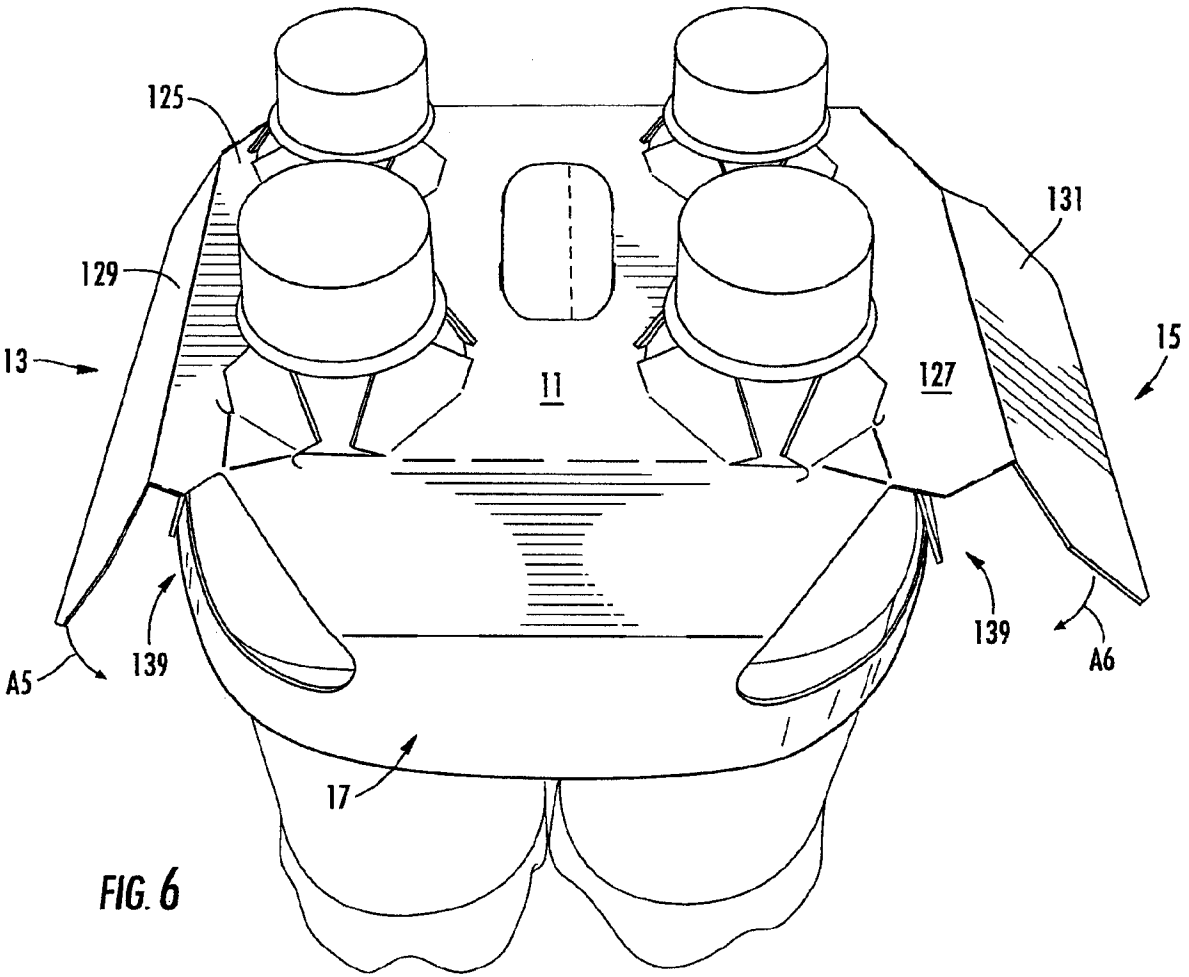
Figure 6A:
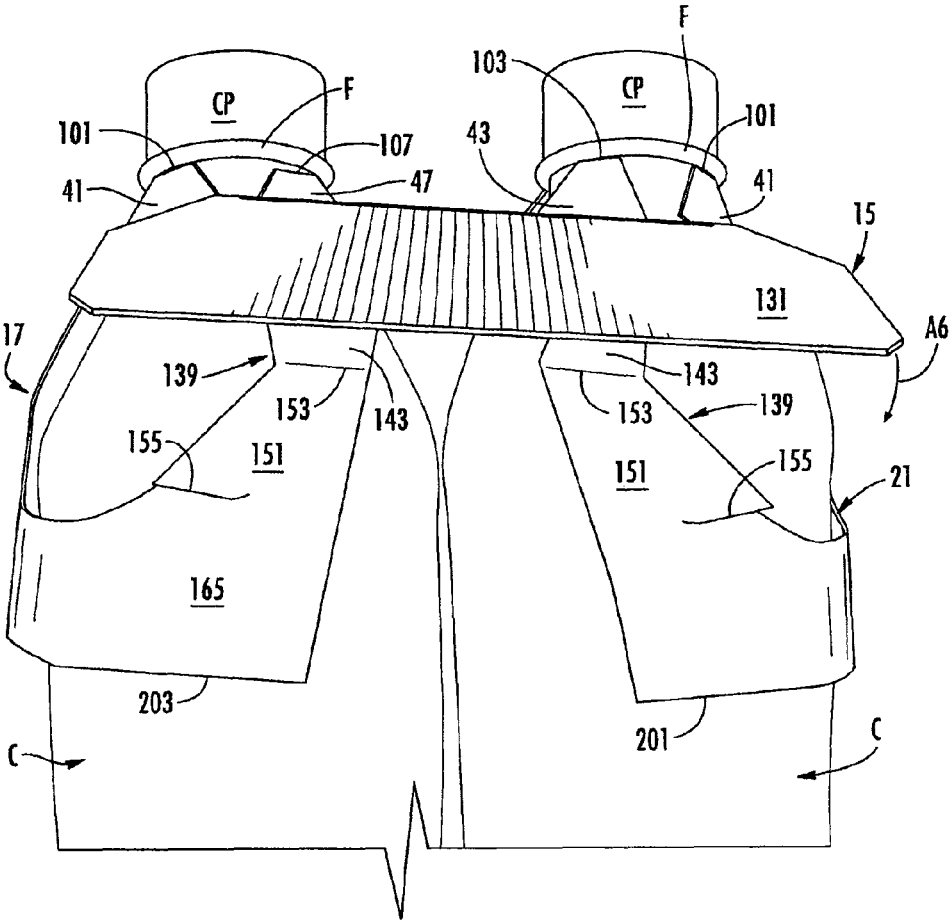
Figure 6B:
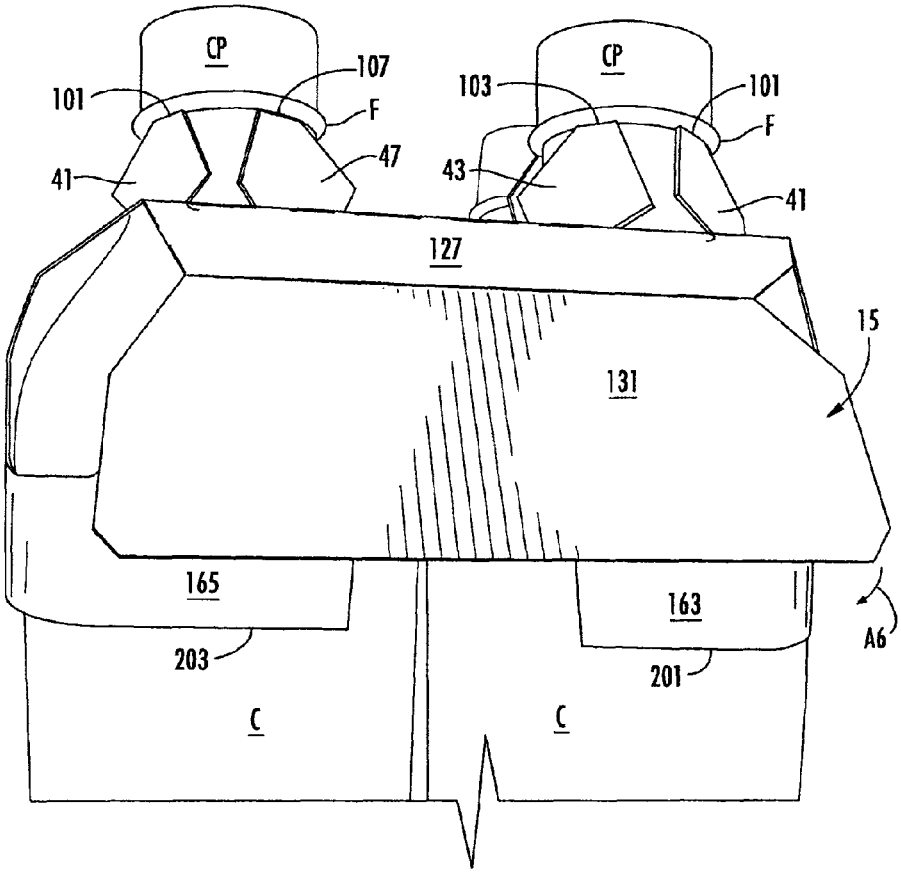
Figure 6C:
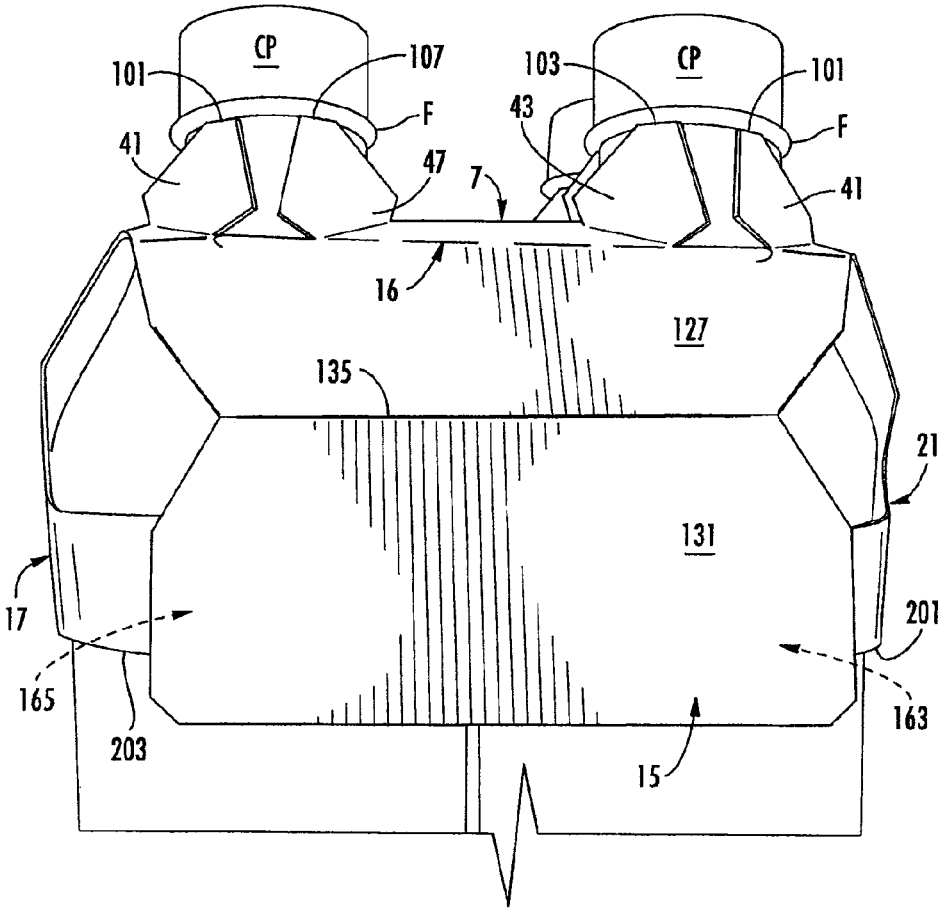

In one embodiment, the forming machine has fingers (not shown) that are lowered into contact with the end panels 13, 15 to downwardly fold the end panels in the direction of arrows A5, A6 (FIG. 4). FIGS. 5-6C show the end panels 13, 15 being downwardly folded relative to the top panel 11 and the positioning of the gussets 139. When the end panels 13, 15 are downwardly folded, the gussets 139 are activated so that the first gusset panel 143 is folded to be in face-to-face contact with the second gusset panel 151. The gussets 139 are configured to position the side panels 17, 21 and end panels 13, 15 in a manner that provides a tight fight around the containers C. FIGS. 6A-6C are end views of the final stages of assembly of the blank 5 into the package 7 showing the downward folding of the end panel 15 in the direction of arrow A6. The other end panel 13 is folded downwardly in the direction of arrow A5 and is folded in a similar manner as the end panel 15. When the gussets 139 are activated and the end panel 15 downwardly folded, the fold lines 153 connecting the first and second gusset panels 143, 151 are raised from the position shown in FIG. 6A to a positioned that is approximately directly below or closely adjacent the fold lines 16 (FIG. 6C) connecting the end panel 15 to the top panel 11. In this way, the gussets 139 are configured to provide a tight fit of the blank 5 around the containers C. Further, when the end panel 15 is downwardly folded, the bottom edges 201, 203 of the adhesive portions 163, 165 of the side panels 17, 21 are raised from the position of FIG. 6A to the fully assembled position of FIG. 6C wherein the bottom edges are located closer to the top panel 11 in the fully assembled position of FIG. 6C. Prior to downwardly folding the end panels 13, 15, glue or other adhesive can be placed on the adhesive portions 159, 161, 163, 165 and/or the second portions 129, 131 of the end flaps. When the end flaps 13, 15 are downwardly folded, the adhesive portions 159, 161, 163, 165 that are partially defined by the cuts 155 can move relative to the rest of the side panels 17, 21 to facilitate application of glue to the blank 5. The cut line 155 allows each of the adhesive portions 159, 161, 163 165 to flex and conform to the shape of the container C when the downwardly folded end flap 13, 15 is pressed against the adhesive portion to provide a firm surface to allow the end flap and the adhesive portion to be pressed together. Further, the adhesive portions 159, 161, 163, 165 allow a firm surface for the application of glue. Further, glue can be applied to the second gusset panel 151 and/or the first gusset panel 143 without departing from the disclosure.

In one embodiment, the oblique fold lines 31, 33 in the top panel 11 form the corners 29 of the top panel of the package 7 that are reinforced and are strengthened by the slight oblique positioning of the fold lines 31, 33 relative to the fold lines 14, 16, 19, 23. Also, the J-shaped cuts 67, 69 that are adjacent each corner 29 strengthen the package 7 by preventing tearing at the corners of the package.

In one embodiment, the receptacles 27 with T-shaped cuts 55, 57, 59, 69 defining the retention flaps 41, 43, 45, 47 are easier to open and access than other receptacle/retention flap designs. The blank 5 could be otherwise shaped, arranged, and/or configured and could have other features (e.g., dispensing features) without departing from the scope of the disclosure.

Figure 8:
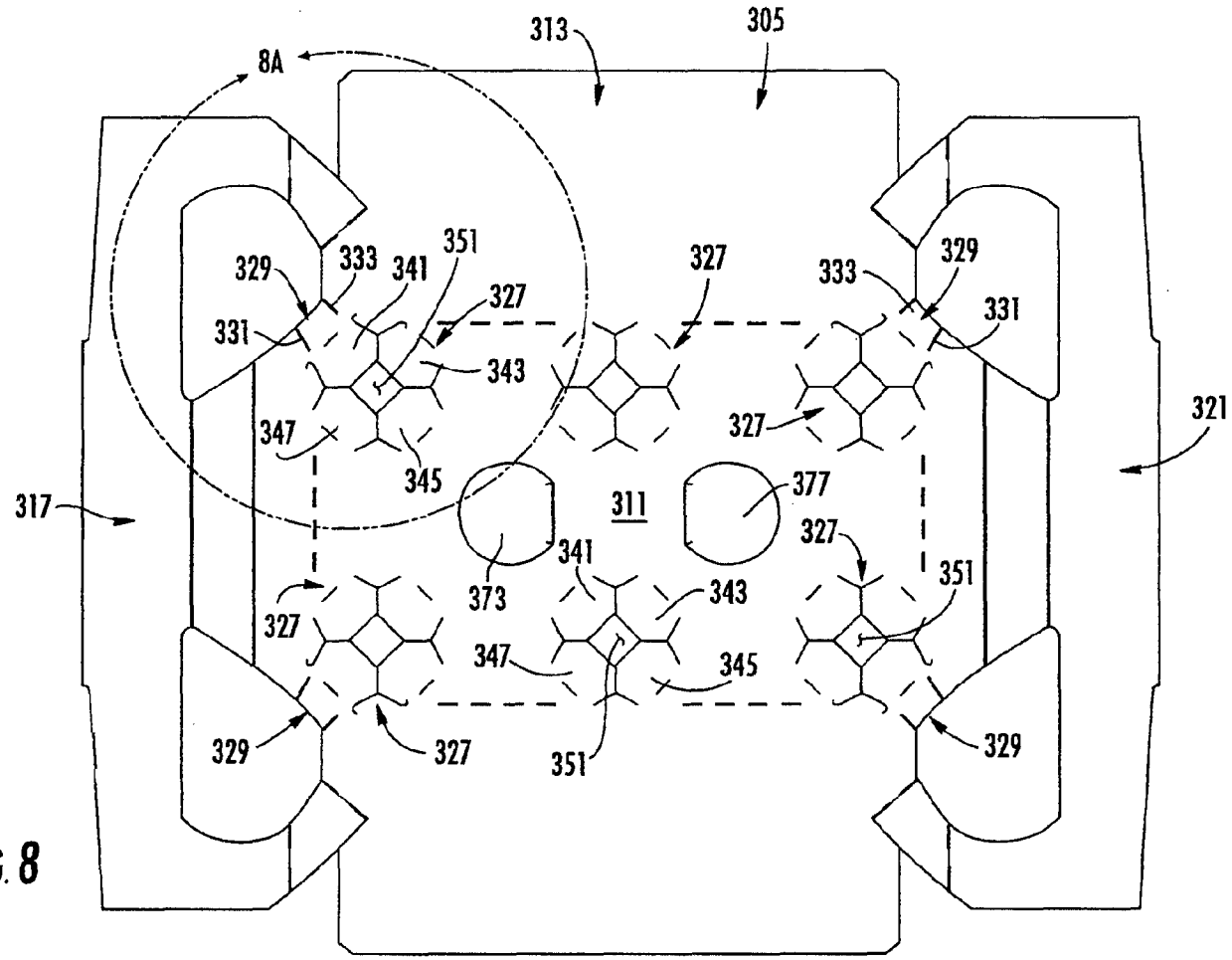
FIG. 8 is a plan view of an exterior surface of a blank for forming a package of a second embodiment of the disclosure.
Figure 8A:
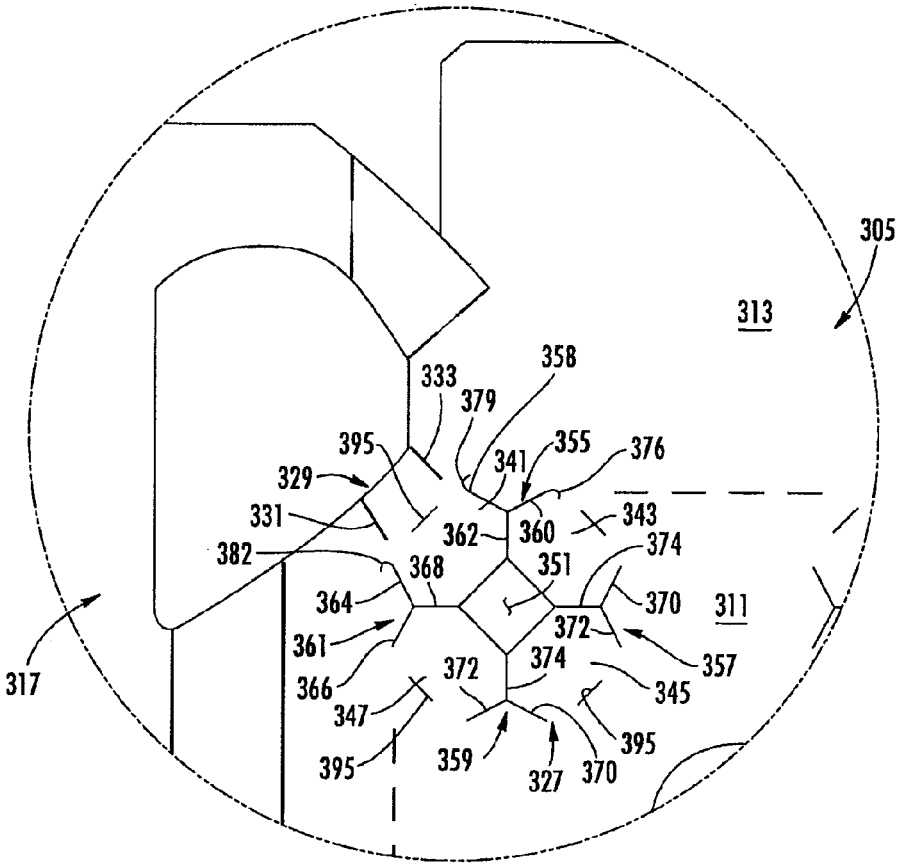
FIG. 8A is an enlarged portion of FIG. 8.

FIG. 8 shows a blank 305 of a second embodiment that is similar to the blank 5 of the first embodiment. Accordingly, like or similar features between the two embodiments are indicated with like or similar reference numbers. The blank 8 has a top panel 311, end panels 313, 315 foldably connected to the top panel, and side panels 317, 321 foldably connected to the top panel. The blank 305 has receptacles 327 that are similar to the receptacles 27 of the first embodiment. As shown in FIGS. 8 and 8A, the top panel has oblique fold lines 331, 333 at a respective corner 329 of the top panel. Each receptacle 327 includes four retention flaps 341, 343, 345, 347 that frame a respective opening 351 in the top panel 311.

The receptacle 327 includes four Y-shaped cuts 355, 357, 359, 361 that at least partially define the retention flaps 341, 343, 345, 347. The Y-shaped cut 355 has two oblique J-shaped cut portions 358, 360 that converge at a straight longitudinal portion 362 that extends to the opening 351. The Y-shaped cut 361 has one oblique J-shaped cut portion 364 and a straight oblique cut portion 366 that converge at a straight longitudinal portion 368 that extends to the opening 351. The other Y-shaped cuts 357, 359 have converging oblique potions 370, 372 that intersect a straight portion 374 that extends to the opening 351. Cuts 395 form fold lines or lines of weakening that foldably connect the retention flaps 341, 343, 345, 347 to the top panel 311. The receptacles 327 can be otherwise shaped, arranged, and/or configured without departing from the disclosure.

In the embodiment of FIGS. 8 and 8A, the J-shaped cut portion 360 has a curved end portion 376 that terminates in the top panel 311. The J-shaped cut portion 358 has a curved end portion 379 that terminates in the end panel 313. The J-shaped cut portion 364 has a curved end portion 382 that terminates in the side panel 317. The J-shaped cut portions 358, 360, 364 could be otherwise shaped, arranged, and/or configured without departing from the disclosure.

In one embodiment, the blank 305 has two handle panels 373, 377 that are foldably connected to the top panel 311. The blank 305 could have other handle features or the handle panels 373, 377 could be otherwise shaped, arranged, configured, and/or omitted without departing from the disclosure.

The blank 305 is formed into a package in a similar manner as the blank 5 and package 7. The retention flaps 341, 343, 345, 347 are configured to engage and retain containers C when the blank 308 is formed into the package.

The blank 305 could have other features and the illustrated features could be otherwise shaped, arranged, and/or configured without departing from the disclosure.

Figure 9:
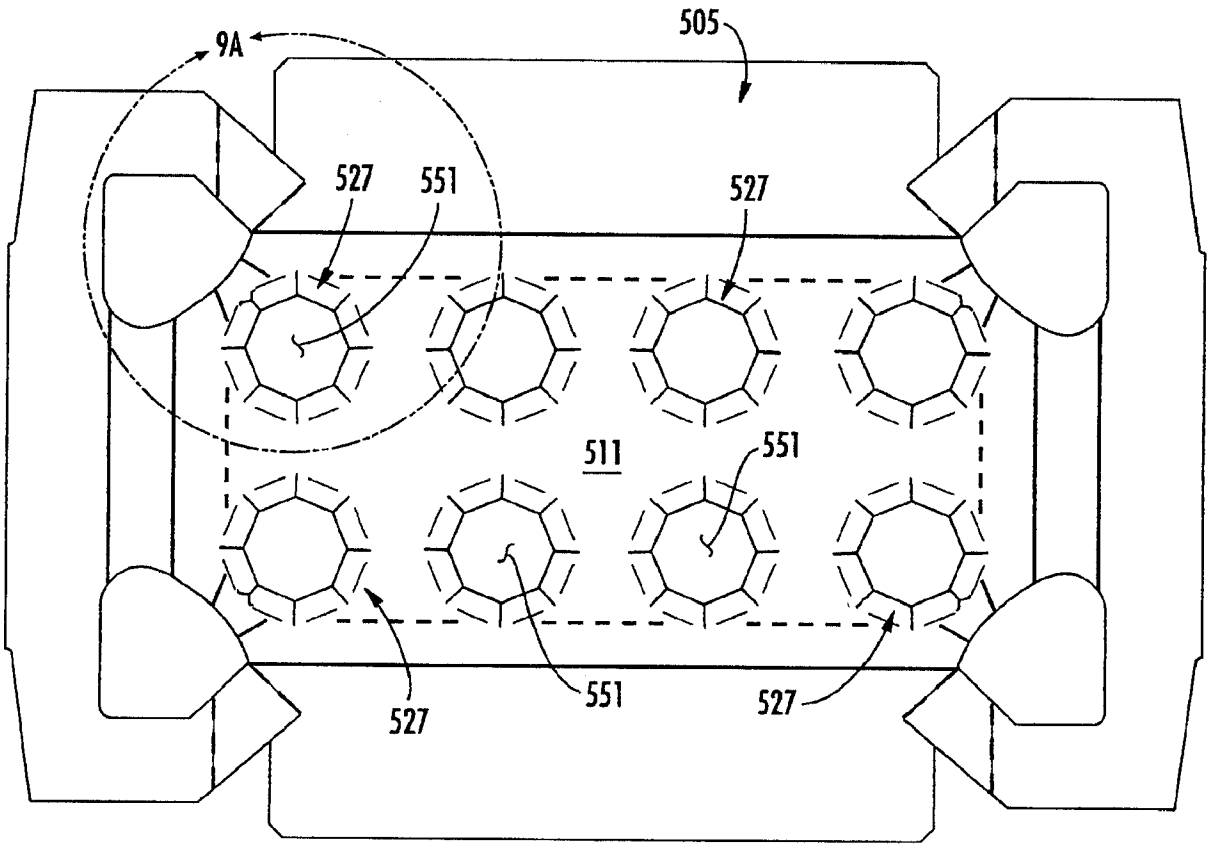
FIG. 9 is a plan view of an exterior surface of a blank for forming a package of a third embodiment of the disclosure.
Figure 9A:
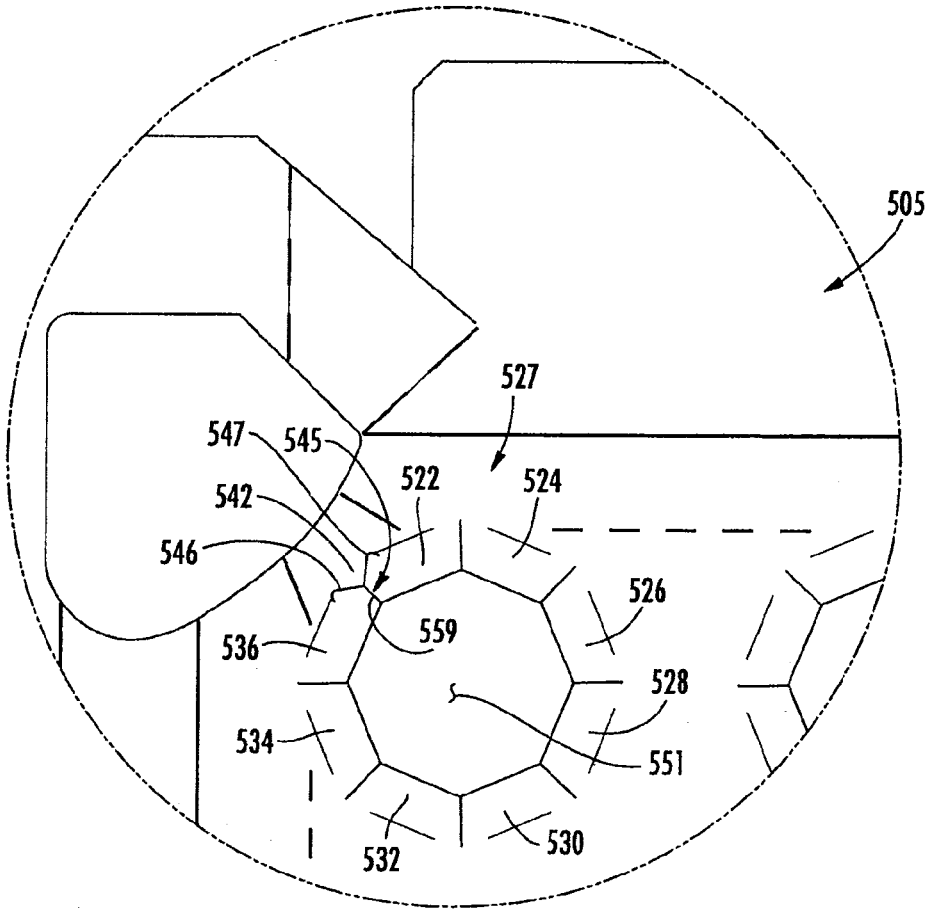
FIG. 9A is an enlarged portion of FIG. 9.

FIGS. 9 and 9A illustrate a blank 505 for forming a package of a third embodiment of the disclosure having similar features as the blanks 5, 305 and package 7 of the previous embodiments. Accordingly, similar or identical features of the embodiments are provided with like or similar reference numbers. In the third embodiment, the blank 505 includes eight receptacles 527 in the top panel 511 so that the package formed from the blank 505 is capable of containing eight containers C. Each receptacle 527 includes eight retention flaps 522, 524, 526, 528, 530, 532, 534, 536 that frame the opening 551. Each corner receptacle 527 includes a single retention portion 542 of the top panel 511 that is between adjacent retention flaps 522, 536. Each retention portion 542 is at least partially defined by a Y-shaped cut line 545, that includes two converging, oblique J-shaped cuts 546, 547 and a straight, oblique cut 549 extending from the intersection of the J-shaped cuts to the opening 551. The retention flaps 522, 536 are at least partially defined by the respective J-shaped cuts 546, 547. The other retention flaps 524, 526, 528, 530, 532, 534 are defined by straight cuts extending from the opening 551. The retention flaps 522, 524, 526, 528, 530, 532, 534, 536 could be otherwise shaped, arranged, and/or configured without department from the scope of the disclosure.

The blank 505 could be otherwise shaped, arranged, and/or configured without departing from the scope of the disclosure.

Figure 10:
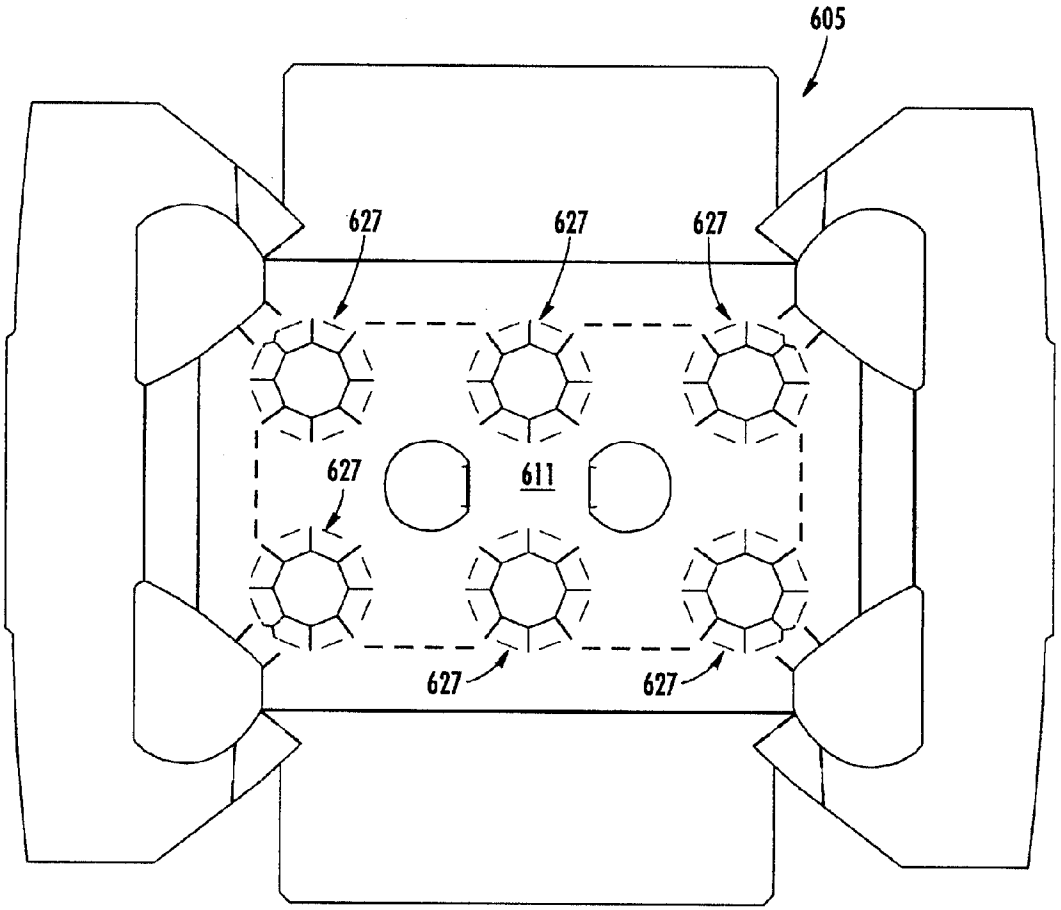
FIG. 10 is a plan view of an exterior surface of a blank for forming a package of a fourth embodiment of the disclosure.

FIG. 10 illustrates a blank 605 for forming a package according to a fourth embodiment of the disclosure. The blank 605 of the fourth embodiment is generally similar to the blank 505 of the third embodiment, except that the blank 605 has six receptacles 627 in the top panel 611. The receptacles 627 are similarly shaped and configured as the receptacles 527 of the third embodiment.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. Further, the fold line can extend beyond the form or line of weakening (e.g., score line, cut, etc.) created in the material such that the unaltered material adjacent the line of weakening is more easily folded.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding a plurality of articles, the package comprising:

panels that cooperate to at least partially form an interior of the package, the panels comprise a top panel, at least one side panel foldably connected to the top panel at a first fold line, and at least one end panel foldably connected to the top panel at a second fold line, the top panel comprising at least one corner at least partially defined by a first corner fold line and a second corner fold line, the first corner fold line being oblique relative to the first fold line and the second corner fold line being oblique relative to the second fold line;

at least one opening in the top panel for at least partially receiving at least a portion of one of the articles, the at least one opening being adjacent the at least one corner of the top panel;

at least one retention flap foldably connected to the top panel adjacent the at least one opening, the at least one retention flap having a free edge for engaging at least one article of the plurality of articles, the at least one retention flap being at least partially defined by at least a first J-shaped cut and a second J-shaped cut, each of the first J-shaped cut and the second J-shaped cut comprises a respective straight portion and a respective curved portion, the respective straight portion being generally aligned with one of the first fold line and the second fold line and the respective curved portion extending into one of the at least one side panel and the at least one end panel.

2. The package of claim 1 wherein the straight portion of the first J-shaped cut being generally aligned with the first fold line, and the straight portion of the second J-shaped cut being generally aligned with the second fold line.

3. The package of claim 2 wherein the curved portion of the first J-shaped cut extends into the at least one end panel at a location adjacent the at least one corner of the top panel, and the second J-shaped cut extends into the at least one side panel at a location adjacent to the at least one corner of the top panel.

4. The package of claim 3 wherein the at least one retention flap is at least partially defined by a fold line adjacent the at least one corner and extending generally between respective ends of respective curved portions of the first J-shaped cut and the second J-shaped cut.

5. The package of claim 1 wherein the retention flap is further defined by an orthogonal cut extending from a respective one of the first J-shaped cut and the second J-shaped cut to the free edge.

6. The package of claim 5 wherein each of the first J-shaped cut and the second J-shaped cut and the respective orthogonal cut form a respective T-shaped cut.

7. The package of claim 6 wherein each of the first J-shaped cut and the second J-shaped cut and the respective orthogonal cut form a respective Y-shaped cut.

8. The package of claim 1 wherein the first corner fold line extends from a location adjacent the first J-shaped cut and second corner fold line extends from a location adjacent the second J-shaped cut.

9. The package of claim 8 wherein the first and second corner fold lines are oblique relative to the respective straight portions of the first J-shaped cut and the second J-shaped cut.

10. The package of claim 1 wherein the at least one side panel is foldably connected to the at least one end panel by a gusset, the gusset comprising a first gusset panel foldably connected to the at least one end panel and a second gusset panel foldably connected to the first gusset panel and the at least one side panel, the second gusset panel being at least partially defined by a cut line.

11. The package of claim 10 wherein the cut line at least partially defines an adhesive portion of the at least one side panel that is adjacent the second gusset panel, the adhesive portion being adhesively secured to the at least one end flap.

12. The package of claim 1 in combination with the articles, the articles comprising containers having an upper portion and a flange, wherein the at least one opening comprises a plurality of openings, the at least one retention flap comprises a plurality of retention flaps foldably attached to the top panel and each having a respective free edge that engages the flange of a respective container.

13. The package of claim 1 wherein the at least one retention flap is a first corner retention flap, the package further comprising a second retention flap, a third retention flap, and a fourth retention flap adjacent the at least one opening, the second retention flap, third retention flap, and fourth retention flap cooperate with the corner retention flap to engage a respective one of the articles.

14. A blank for forming a package for holding a plurality of articles, the blank comprising:

panels that comprise a top panel, at least one side panel foldably connected to the top panel at a first fold line, and at least one end panel foldably connected to the top panel at a second fold line, the top panel comprising at least one corner at least partially defined by a first corner fold line and a second corner fold line, the first corner fold line being oblique relative to the first fold line and the second corner fold line being oblique relative to the second fold line;

at least one opening in the top panel for at least partially receiving at least a portion of one of the articles when the blank is formed into the carton, the at least one opening being adjacent the at least one corner of the top panel;

at least one retention flap foldably connected to the top panel for being adjacent the at least one opening when the blank is formed into the carton, the at least one retention flap having a free edge for engaging at least one article of the plurality of articles, the at least one retention flap being at least partially defined by at least a first J-shaped cut and a second J-shaped cut, each of the first J-shaped cut and the second J-shaped cut comprises a respective straight portion and a respective curved portion, the respective straight portion being generally aligned with one of the first fold line and the second fold line and the respective curved portion extending into one of the at least one side panel and the at least one end panel.

15. The blank of claim 14 wherein the straight portion of the first J-shaped cut being generally aligned with the first fold line, and the straight portion of the second J-shaped cut being generally aligned with the second fold line.

16. The blank of claim 15 wherein the curved portion of the first J-shaped cut extends into the at least one end panel at a location adjacent the at least one corner of the top panel, and the second J-shaped cut extends into the at least one side panel at a location adjacent to the at least one corner of the top panel.

17. The blank of claim 16 wherein the at least one retention flap is at least partially defined by a fold line adjacent the at least one corner and extending generally between respective ends of respective curved portions of the first J-shaped cut and the second J-shaped cut.

18. The blank of claim 14 wherein the retention flap is further defined by an orthogonal cut extending from a respective one of the first J-shaped cut and the second J-shaped cut to the free edge, and each of the first J-shaped cut and the second J-shaped cut and the respective orthogonal cut form a respective T-shaped cut.

19. The blank of claim 18 wherein the free edge is adjacent the at least one opening in the top panel.

20. The blank of claim 14 wherein the first corner fold line extends from a location adjacent the first J-shaped cut and the second corner fold line extends from a location adjacent the second J-shaped cut, the first and second corner fold lines are oblique relative to the respective straight portions of the first J-shaped cut and the second J-shaped cut.

21. The blank of claim 14 wherein the at least one side panel is foldably connected to the at least one end panel by a gusset, the gusset comprising a first gusset panel foldably connected to the at least one end panel and a second gusset panel foldably connected to the first gusset panel and the at least one side panel, the second gusset panel being at least partially defined by a cut line, the cut line at least partially defines an adhesive portion of the at least one side panel that is adjacent the second gusset panel.

22. The blank of claim 14 wherein a first longitudinal end of the blank comprises a first edge of the blank comprising an edge of the side panel, and a second edge of the blank comprising an edge of the at least one end panel, the first edge being spaced apart from a laterally-extending centerline of the blank by a first distance and the second edge being spaced apart from the laterally-extending centerline of the blank by a second distance, the second distance being greater than the first distance so that the blank can be engaged at the at least one end panel to convey the blank in a direction perpendicular to the longitudinal direction of the blank.

* * * * *